US005578896A

United States Patent [19]

Huang

[11] Patent Number: 5,578,896

[45] Date of Patent: Nov. 26, 1996

[54] COLD CATHODE FIELD EMISSION DISPLAY AND METHOD FOR FORMING IT

[75] Inventor: Jammy C. Huang, Taipei, Taiwan

[73] Assignee: Industrial Technology Research Institute, Hsinchu, Taiwan

[21] Appl. No.: 419,435

[22] Filed: Apr. 10, 1995

[51] Int. Cl.[6] ..... H01J 1/02

[52] U.S. Cl. ..... 313/309; 313/336; 445/24

[58] Field of Search ..... 313/309, 336; 445/24, 50

[56] References Cited

U.S. PATENT DOCUMENTS

| | | | |
|---|---|---|---|
| 4,940,916 | 7/1990 | Borel et al. | 313/306 |
| 5,142,184 | 8/1992 | Kane | 313/309 |
| 5,194,780 | 3/1993 | Meyer | 315/169.3 |
| 5,502,347 | 3/1996 | Dworsky et al. | 313/309 |
| 5,536,993 | 7/1996 | Taylor et al. | 313/336 |

*Primary Examiner*—Kenneth J. Ramsey
*Attorney, Agent, or Firm*—George O. Saile

[57] ABSTRACT

A cold cathode field emission display is described. A key feature of its design is that each individual microtip has its own ballast resistor. The latter is formed from a resistive layer that has been interposed between the cathode line and the substrate. When openings for the microtips are formed in the gate line, extending down as far as the resistive layer, an overetching step is introduced. This causes the dielectric layer to be substantially undercut immediately above the resistive layer thereby creating an annular resistor positioned between the gate line and the base of the microtip.

18 Claims, 3 Drawing Sheets

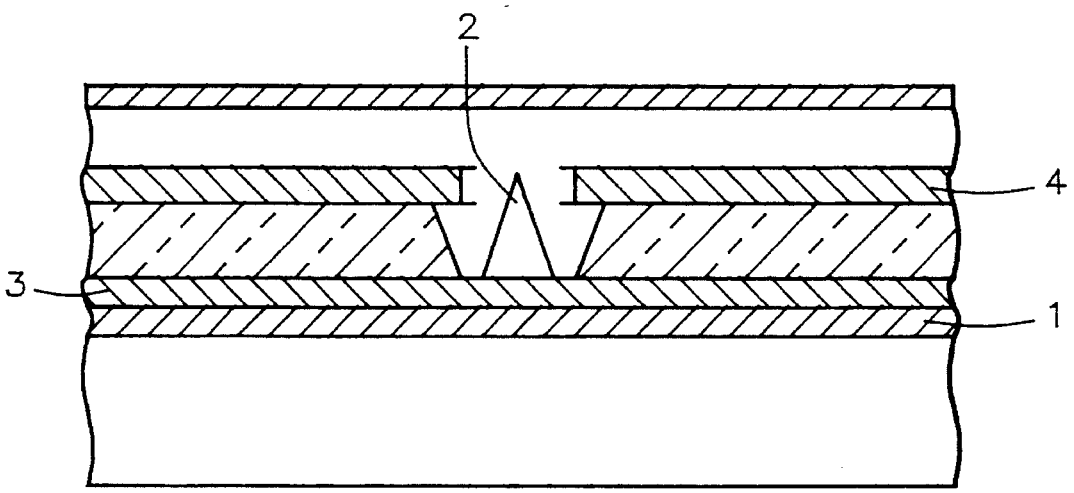
FIG. 1 – Prior Art
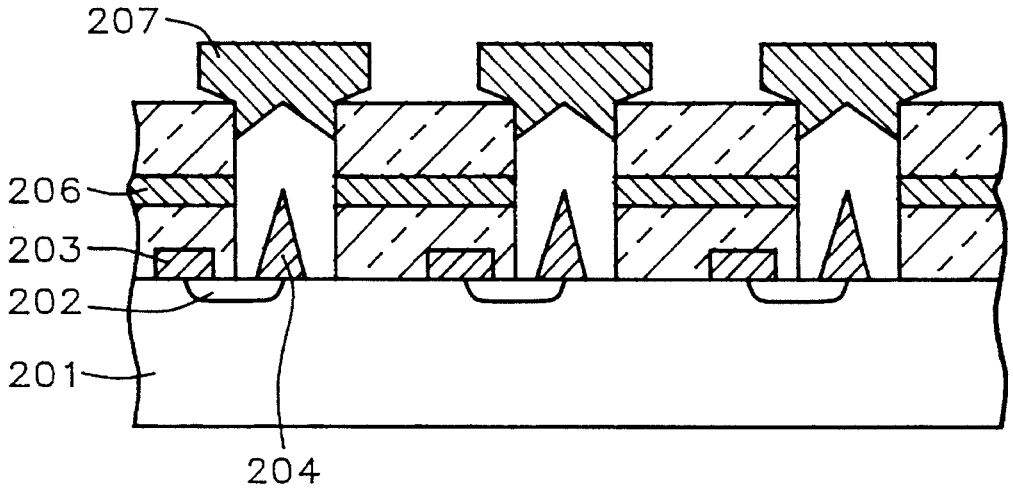
FIG. 2 – Prior Art

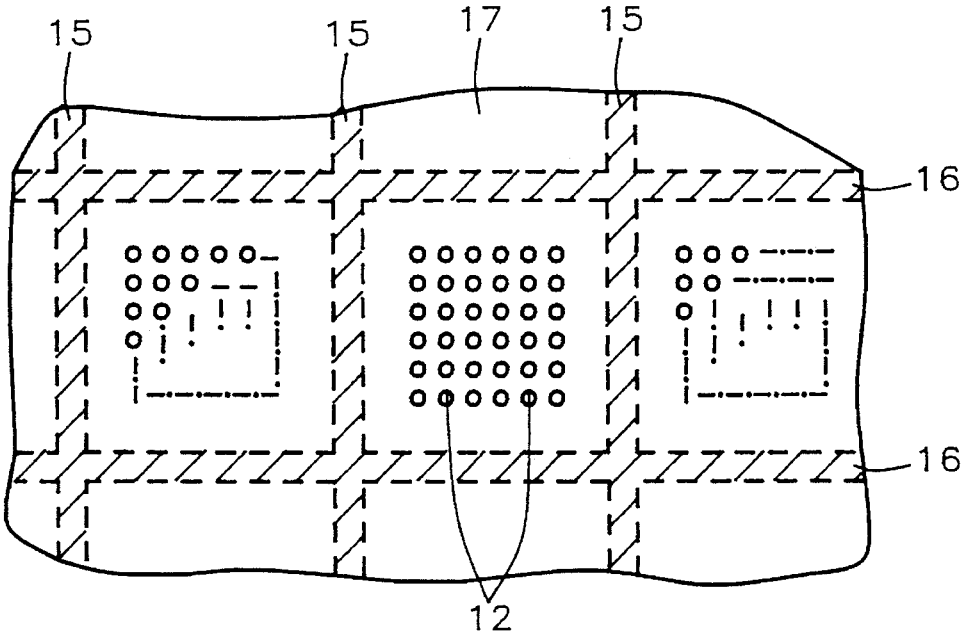
FIG. 3 – Prior Art
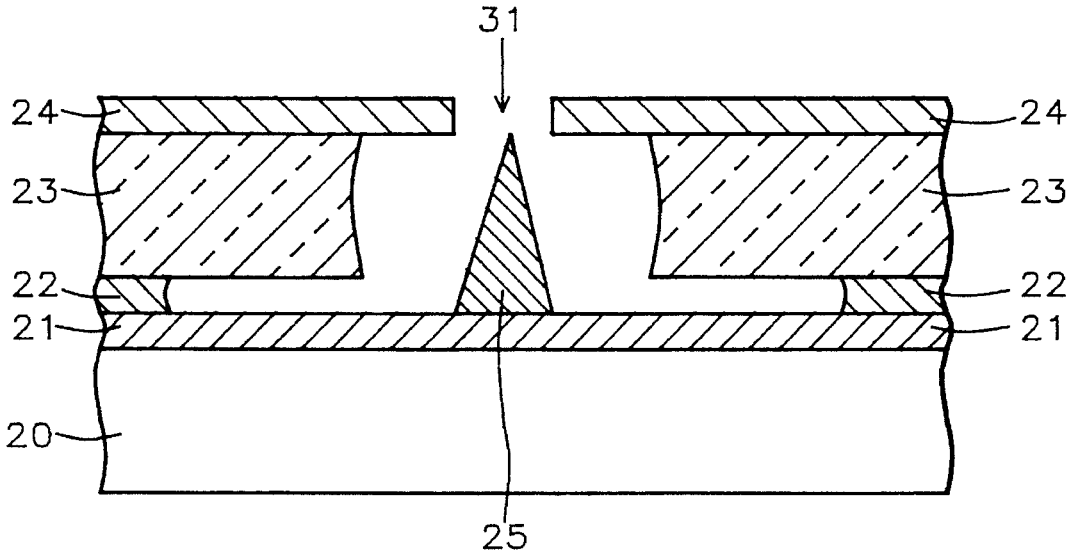
FIG. 4

COLD CATHODE FIELD EMISSION DISPLAY AND METHOD FOR FORMING IT

BACKGROUND OF THE INVENTION (1) Field of the Invention

The invention relates to cold cathode field emission displays.

(2) Description of the Prior Art

Cold cathode electron emission devices are based on the phenomenon of high field emission wherein electrons can be emitted into a vacuum from a room temperature source if the local electric field at the surface in question is high enough. The creation of such high local electric fields does not necessarily require the application of very high voltage, provided the emitting surface has a sufficiently small radius of curvature.

The advent of semiconductor integrated circuit technology made possible the development and mass production of arrays of cold cathode emitters of this type. In most cases, cold cathode field emission displays comprise an array of very small conical emitters, each of which is connected to a source of negative voltage via a cathode conductor line. Another set of conductive lines (called gate lines) is located a short distance above the cathode lines at an angle (usually 90°) to them, intersecting with them at the locations of the conical emitters or microtips, and connected to a source of positive voltage. Both the cathode and the gate line that relate to a particular microtip must be activated before there will be sufficient voltage to cause cold cathode emission.

The electrons that are emitted by the cold cathodes accelerate past openings in the gate lines and strike an electroluminescent panel that is located a short distance above the gate lines. Thus, each of the microtips serves as a single pixel for the total display. In general, even though the local electric field in the immediate vicinity of a microtip is in excess of 1 million volts/cm., the externally applied voltage is only of the order of 100 volts. However, even a relatively low voltage of this order can obviously lead to catastrophic consequences, if short circuited.

The early prior art in this technology used external resistors, placed between the cathode or gate lines and the power supply, as ballast to limit the current in the event of a short circuit occurring somewhere within the display. While this approach protected the power supply, it could not discriminate between individual microtips on a given cathode or gate line. Thus, in situations where one (or a small number) of the microtips is emitting more than its intended current, no limitation of its individual emission is possible. Such excessive emission can occur as a result of too small a radius of curvature for a particular microtip or the local presence of gas, particularly when a cold system is first turned on. Consequently the more recent art in this technology has been directed towards ways of providing individual ballast resistors, preferably one per microtip.

The approach favored by Borel et al. (U.S. Pat. No. 4,940,916 Jul. 1990) is illustrated in FIG. 1. This shows a schematic cross-section through a single pixel. As already discussed, current to an individual microtip 2 is carried by a cathode line 1 and a gate line 4. However, a high resistance layer 3 has been interposed between the base of the microtip and the cathode line, thereby providing the needed ballast resistor. While this invention satisfies the objective of providing each microtip with its own ballast resistor, it has a number of limitations.

The resistivity that layer 3 will need in order to serve as a ballast resistor is of the order of $5\times10^4$ ohm cm. This significantly limits the choice of available materials. Furthermore, sustained transmission of current across a film is substantially less reliable than transmission along a film. The possibility of failure as a result of local contamination or local variations in thickness is much greater for the first case. Consequently, later inventions have focused on providing individual ballast resistors wherein current flows along the resistive layer, rather than across it.

Kane (U.S. Pat. No. 5,142,184 August 1992) used semiconductor integrated circuit technology to generate his cold cathode display so that individual ballast resistors could be provided in the same way that resistors are provided within integrated circuits in general. FIG. 2 is a schematic cross-section, showing a group of three pixels. Cathode line 203 has been deposited onto silicon substrate 201 and is connected to microtip 204 via diffused resistor 202. Gate 206 and electroluminescent anode 207 complete the basic design. This approach meets the requirement of current transmission along, rather than across, the resistive layer but makes for a more expensive system since an additional mask and diffusion step are required. Additionally, a certain amount of space must be made available for the diffused resistors.

The approach taken by Meyer (U.S. Pat. No. 5,194,780 March 1993) is illustrated in FIG. 3. This shows, in plan view, a portion of a single cathode line which, instead of being a continuous sheet, has been formed into a mesh of lines 15 intersecting with lines 16. A resistive layer 17 has been interposed between the mesh and the substrate (not shown here). Microtips 12 have been formed on the resistive layer and located within the interstices of the mesh. A single gate line intersects the cathode line/mesh, and current from the mesh must first travel along resistive layer 7 before it reaches the microtips. An important disadvantage of this approach is that the presence of the mesh limits the resolution of the display. As will be seen when the present invention is described below, there are easier ways of achieving a good design without the need to sacrifice resolution. Another disadvantage is that the values of the ballast resistors associated with the various microtips vary widely because of the geometry of this design.

SUMMARY OF THE INVENTION

It is therefore an object of this invention to provide a cold cathode field emission display that includes a separate ballast resistor for each field emitting microtip.

A further object of the invention is that the provision of individual ballast resistors should not result in a reduction in the resolution of the display.

Another object of the invention is that such individual ballast resistors be both robust and reliable.

Yet another object of the invention is to provide a method for manufacturing a display that satisfies the previous objects at minimum cost.

These objects have been achieved by interposing a resistive layer between the cathode lines and the substrate and then forming openings at the cathode-gate line intersections (where the individual microtips are located) shaped in such a manner that current flowing from the gate line to a microtip has to travel a significant distance along the resistive layer in order to reach the microtip.

BRIEF DESCRIPTION OF THE DRAWINGS

FIGS. 1 to 3 illustrate proposed designs in the prior art for providing an individual ballast resistor for each pixel of the display.

FIG. 4 is a cross-section through a pixel design based on the present invention.

DESCRIPTION OF THE PREFERRED EMBODIMENTS

Figure 5:
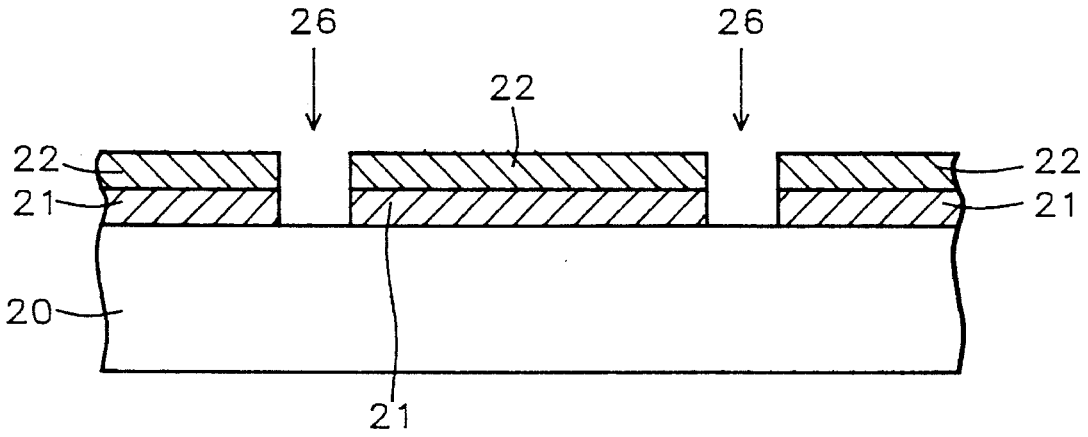
FIGS. 5 and 6 illustrate steps in the process that has been disclosed for manufacturing the present invention.

Referring now to FIG. 4, we illustrate the main features of the present invention by showing a schematic cross-section of a single pixel cell. Cathode line 22 has been deposited onto resistive layer 21 which was itself deposited onto insulating substrate 20. The cathode line's major dimension is in a direction perpendicular to the plane of the figure. Gate line 24 lies above cathode line 22 and is separated therefrom by dielectric layer 23. Both gate and cathode lines are formed of metals such as molybdenum, niobium, aluminum, titanium, or chromium, while any of the standard dielectric materials such as silicon oxide, aluminum oxide, titanium oxide, or silicon nitride may be used.

Cone shaped microtip 25 is located at the center of the intersection of gate line 24 with cathode line 22. The base of said cone rests on resistive layer 21 and extends upwards therefrom so that its apex is level with gate line 24. An opening 31 has been formed in gate line 24, said opening extending downward as far as the upper surface of resistive layer 21. The sheet resistance of layer 21 is usually between $10_3$ and $10_9$ ohms/square while its thickness is usually between 500 and 15,000 Angstrom units. The material used for layer 21 may be any of the commonly used thin film resistor materials such as nickel-chromium alloy, chromium, chromium-silicon monoxide alloy, tin oxide, indium oxide, sputtered silicon, or amorphous silicon.

A key feature of the invention is that the width of opening 31 is significantly greater in the vicinity of resistive layer 21 than it is at the surface near gate line 24. Typically, the ratio of the hole diameter in the vicinity of the cathode line and the hole diameter in the vicinity of the dielectric layer is between 2 and 50 to 1. By keeping the opening relatively small near the surface the capability to accelerate electrons past the gate line towards the electroluminiscent anode (not shown here) is not lost. By making the opening relatively large in the vicinity of resistive layer 21, current flowing from the cathode line 22 to the microtip 25 is forced to travel along resistive layer 21. Thus the object of providing each microtip with its own ballast resistor has been achieved by this design as has the object of no reduction in the resolution of the display.

The process for manufacturing a cold cathode display that is based on the present invention will now be described. Referring to FIG. 5, we show, in schematic cross-section, an insulating substrate 20 on which three cathode lines have been formed. All three cathode lines have their major dimension perpendicular to the plane of the figure. Only the central of the three cathode lines is shown in full, the remaining two that flank it being partly cut off at the figure's edge. The cathode lines are separated from one another by spacings 26, which causes them to be electrically isolated from each other.

Figure 6:
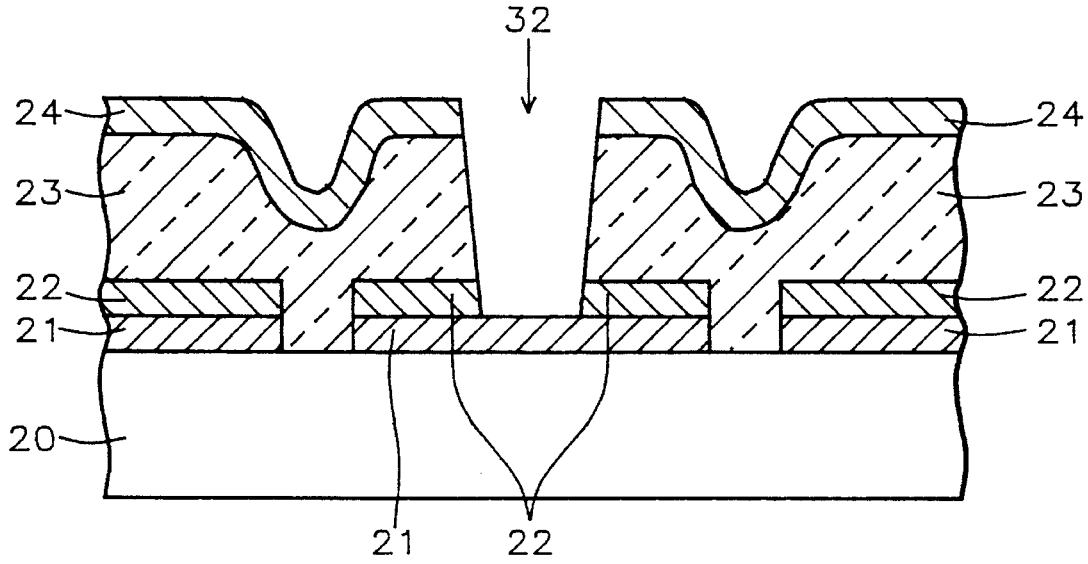

The next stage in the process is illustrated in FIG. 6. The structure seen in FIG. 5 has been coated with dielectric layer 23 followed by gate line 24. Note that the material that comprises the gate line should be different from the material that comprises the cathode line. For example, the gate line could comprise molybdenum while the cathode line could comprise aluminum. An opening 32 has been formed in the gate line and in dielectric layer 23 by etching in buffered hydrofluoric acid for between 2 and 10 minutes. Said opening extends down to the level of cathode line 22.

The key step that follows comprises the continuation of the hole opening process using a different etchant from that which was used to form the openings. In the current example the etchant that was chosen was hydrochloric acid which does not attack resistive layer 21, gate line layer 24, or dielectric layer 23, but does attack cathode line layer 22. This selective etching step enables the openings at the level of the cathode lines to grow wider but not deeper. This is generally referred to as 'over etching'. This changes the appearance of the hole's cross-section to that shown in FIG. 4.

Shaping the profile of the openings according to the just described process results in the interposition of an annular resistor between the gate line and each microtip. The latter may now be deposited and formed within the openings following which the gate lines may be added, etc. etc. Said annular shape for the individual ballast resistors makes for a very reliable component which does not easily short circuit or open up. Typically, the values of these annular resistors are between $10^3$ and $10^8$ ohms, depending on the voltage between gate and cathode. In a given batch, resistor values have been found to vary by no more than 20% about the mean.

While the invention has been particularly shown and described with reference to the preferred embodiments described above, it will be understood by those skilled in the art that various changes in form and details may be made without departing from the spirit and scope of the invention.

What is claimed is:

1. A cold cathode field emission display comprising:

a dielectric substrate;

cathode columns for said display, formed of parallel, spaced conductors over said substrate;

an electrically resistive layer between said columns and said substrate;

gate lines for said display, formed of parallel, spaced conductors, over, and at an angle to, and comprising a different material from, said cathode columns;

a dielectric layer between said cathode columns and said gate lines;

a plurality of openings, located at the intersections of said cathode columns and said gate lines, passing through said gate lines, said dielectric layer and said cathode columns, the width of each of said openings being greater in that part that is surrounded by material from said cathode columns than elsewhere; and a plurality of cone shaped field emission microtips, each centrally located within one of the openings, the base of each of said microtips being in contact with said electrically resistive layer and the apex of each microtip being in the same plane as that of said gate lines.

2. The field emission display of claim 1 wherein said cathode lines comprise aluminum and said gate lines comprise molybdenum.

3. The field emission display of claim 1 wherein the resistive film is taken from the group consisting of nickel-chromium alloy, chromium, chromium-silicon monoxide alloy, tin oxide, indium oxide, sputtered silicon, and amorphous silicon.

4. The field emission display of claim 1 wherein the sheet resistance of said resistive film is between $10^3$ and $10^9$ ohms per square.

5. The field emission display of claim 1 wherein the thickness of said resistive film is between 50 and $10^4$ Angstrom units.

6. The field emission display of claim 1 wherein the resistance between any one of the field emission microtips and a cathode column is between $10^3$ and $10^8$ ohms.

7. The field emission display of claim 1 wherein the resistances between the field emission microtips and the cathode columns vary from one another by no more than 20%.

8. The field emission display of claim 1 wherein the maximum width of said opening at the level of the cathode lines is between 2 and 50 times the maximum width of said opening at the level of the dielectric layer.

9. The field emission display of claim 1 wherein the gate lines are formed of a metal.

10. The field emission display of claim 1 wherein the cathode lines are formed of a metal over a resistive layer.

11. The field emission display of claim 10 wherein said metal is taken from the group consisting of molybdenum, niobium, aluminum, titanium, and chromium.

12. The field emission display of claim 1 wherein said dielectric is taken from the group consisting of silicon oxide, aluminum oxide, titanium oxide, and silicon nitride.

13. A method for manufacturing a cold cathode field emission display, comprising:

providing a dielectric substrate;

depositing a layer of electrically resistive material onto one surface of said substrate;

depositing a first layer of electrically conductive material on said layer of electrically resistive material and patterning both layers to form cathode columns comprised of spaced parallel lines;

depositing a dielectric layer on said first electrically conductive layer;

depositing a second electrically conductive layer, comprising material different from that of said first conducting layer, on said dielectric layer and patterning said second layer to form gate lines comprised of spaced parallel lines that lie at an angle relative to said cathode lines;

forming openings at the intersections of said cathode and gate lines in a manner that does not remove said resistive layer;

after said openings have been formed, continuing said forming process so that additional material is removed from inside the openings, primarily from said cathode lines; and forming cone shaped field emission microtips, each centrally located within one of the openings, the base of each of said microtips being in contact with said electrically resistive layer and the apex of each microtip being in the same plane as that of said gate lines.

14. The method of claim 13 wherein said resistive film is taken from the group consisting of nickel-chromium alloy, chromium, chromium-silicon monoxide alloy, tin oxide, indium oxide, sputtered silicon, and amorphous silicon.

15. The method of claim 13 wherein the sheet resistance of said resistive film is between $10^3$ and $10^9$ ohms per square.

16. The method of claim 13 wherein the thickness of said resistive film is between 50 and $10^4$ Angstrom units.

17. The method of claim 13 wherein the openings are formed by etching in buffered hydrofluoric acid for between 2 and 10 minutes.

18. The method of claim 17 wherein the increase in the maximum width at the level of the cathode lines is achieved by overetching for between 5 and 50 additional minutes in hydrochloric acid.

* * * * *